United States Patent [19]

Warlop

[11] Patent Number: 4,697,300

[45] Date of Patent: Oct. 6, 1987

[54] ANTISTATIC VACUUM CLEANER AND METHOD

[76] Inventor: Stephen M. Warlop, 5905 E. 5th St., Tucson, Ariz. 85711

[21] Appl. No.: 916,657

[22] Filed: Oct. 8, 1986

[51] Int. Cl.[4] ..... H05F 3/00

[52] U.S. Cl. ..... 15/327 R; 15/339; 361/212; 361/215; 361/220

[58] Field of Search ..... 15/339, 377, 327 R; 361/212, 215, 220

[56] References Cited

U.S. PATENT DOCUMENTS

| | | | |
|---|---|---|---|
| 1,920,889 | 8/1933 | Pullen | 361/220 X |
| 3,636,285 | 1/1972 | Wickham et al. | 15/377 X |
| 4,193,105 | 3/1980 | Graafmann | 361/215 |
| 4,215,384 | 7/1980 | Elson | 361/215 |
| 4,255,776 | 3/1981 | Cantelli | 361/220 X |
| 4,405,969 | 9/1983 | Swavely | 361/215 |

*Primary Examiner*—Chris K. Moore

*Attorney, Agent, or Firm*—Cahill, Sutton & Thomas

[57] ABSTRACT

A vacuum cleaner for use in industrial applications to clean debris from areas and/or equipment wherein electrostatic discharge from the vacuum cleaner to the area or equipment would be highly undesirable includes a vacuum cleaner mechanism having a vacuum inlet. A long flexible plastic vacuum hose has one end connected to a vacuum intake. The other end of the vacuum hose is attached to a pickup nozzle. An air valve and control are provided in the pickup nozzle. In accordance with the present invention, a long, continuous, electrically "floating" helical conductor is embedded in the flexible plastic vacuum hose, extending from one end to the other. The helical conductor is ungrounded, and makes no electrical contact to either the vacuum producing mechanism or to the pickup nozzle.

9 Claims, 4 Drawing Figures

ANTISTATIC VACUUM CLEANER AND METHOD

BACKGROUND OF THE INVENTION

The invention relates to antistatic vacuum cleaning devices and/or to blowers that move air through a long flexible hose.

There are numerous circumstances in industrial manufacturing operations wherein it is highly desirable to be able to provide a high degree of cleaniness of a work area, workpieces, or equipment. This is often done by means of a suitable industrial vacuum cleaner. Typically, the vacuum cleaner (or blower) utilizes a long piece of flexible hose connected at one end to a vacuum producing mechanism and having a pickup nozzle or the like at the other end, with a control valve on the nozzle for turning on or off the suction at the pickup nozzle. Those skilled in the art know that a quantity of air moving at high speed through an electrically insulative hose or tube often produces buildup of electrostatic charge in the vacuum tube or hose, and that if the vacuum pickup nozzle is brought sufficiently close to a conductive object, such as a grounded conductive workpiece, a piece of test equipment, or the like, an electrostatic discharge will occur. An electrostatic discharge produces a very large surge of current for a very short period of time. It is well-known that such electrostatic discharges can cause many kinds of serious problems, including destroying electronic equipment, producing data errors in electronic data processing systems, etc. Therefore, there has been a continuing need to avoid the effects of electrostatic discharges from industrial vacuum cleaners used to clean such equipment and work areas. Various techniques have been utilized to avoid static charge buildups, including using braided stainless steel wire shields on the vacuum hoses. However, there are various problems that make use of braided stainless steel grounding shields unsatisfactory for industrial vacuum cleaners. For example, an electrical ground connection between equipment being vacuumed and the vacuum producing mechanism could result in an electrical short circuit if the vacuum nozzle inadvertently touched a high voltage conductor in the area being cleaned if the flexible hose is covered with the braided stainless steel electrically grounded shield. Braided stainless steel shields often make the hose too stiff to be conveniently used for some vacuum cleaning operations. U.S. Pat. Nos. 1,223,864, 2,047,216, 2,263,221 and 3,070,132 disclose use of conductors embedded in and/or traversing the length of tubular vacuum hoses to prevent electrostatic charge buildup. However, in each of the disclosed devices, the embedded conductors in the flexible tubing are electrically connected at each end of the hose or tubing to electrically grounded conductors. U.S. Pat. Nos. 3,382,524 and 3,387,319 disclose vacuum cleaners with embedded helical coils in the vacuum hoses for conducting electrical signals from control switches on the handle of the vacuum attachment to a motor contained in the main canister unit. U.S. Pat. Nos. 1,901,330, 1,600,549, 3,555,170 and 3,819,069 disclose use of helical coil springs in flexible tubing to provide additional strength, but do not deal with the problem of electrostatic charge buildup in the hoses. Thus, the state-of-the-art seems to be that all prior art describing any electrical function for embedded helical wires in a vacuum hose requires that the embedded conductors be connected at one end to a grounded conductor that conducts electrical charge away from the helical conductor in the tubing, either to discharge electrostatic charge buildup or to conduct a control signal to a receiving unit.

Thus, there remains an unmet need for a technique for avoiding electrostatic discharges from a flexible vacuum cleaner hose or tube being used to clean areas and/or equipment and/or components that would be damaged by electrostatic discharge, yet providing the safety of having the vacuum pickup nozzle completely electrically isolated from the vacuum-producing mechanism.

SUMMARY OF THE INVENTION

Accordingly, it is an object of the invention to provide a method and apparatus for producing a high speed flow of air through a flexible hose to or from a mechanism such as a vacuum cleaner mechanism or the like, in which a nozzle is completely electrically isolated from the mechanism, yet electrostatic charge buildup due to high speed flow of air through the hose is avoided.

Briefly described, and in accordance with one embodiment thereof, the invention provides a vacuum cleaner or the like including a power suction mechanism or a common vacuum line having a suction intake, a flexible plastic vacuum tube having one end connected to the intake and another end connected to a pickup nozzle, and an ungrounded, electrically floating, single, continuous helical conductor embedded entirely in the plastic hose, so that the helical conductor never contacts air moving in the hose, the suction mechanism, or the pickup nozzle. Alternately, a blower mechanism to produce a high speed jet that can be blown out of a directional nozzle. In the described embodiment of the invention, a manual control valve is provided in the pickup nozzle to turn the air flow on and off.

DETAILED DESCRIPTION OF THE INVENTION

Figure 1:
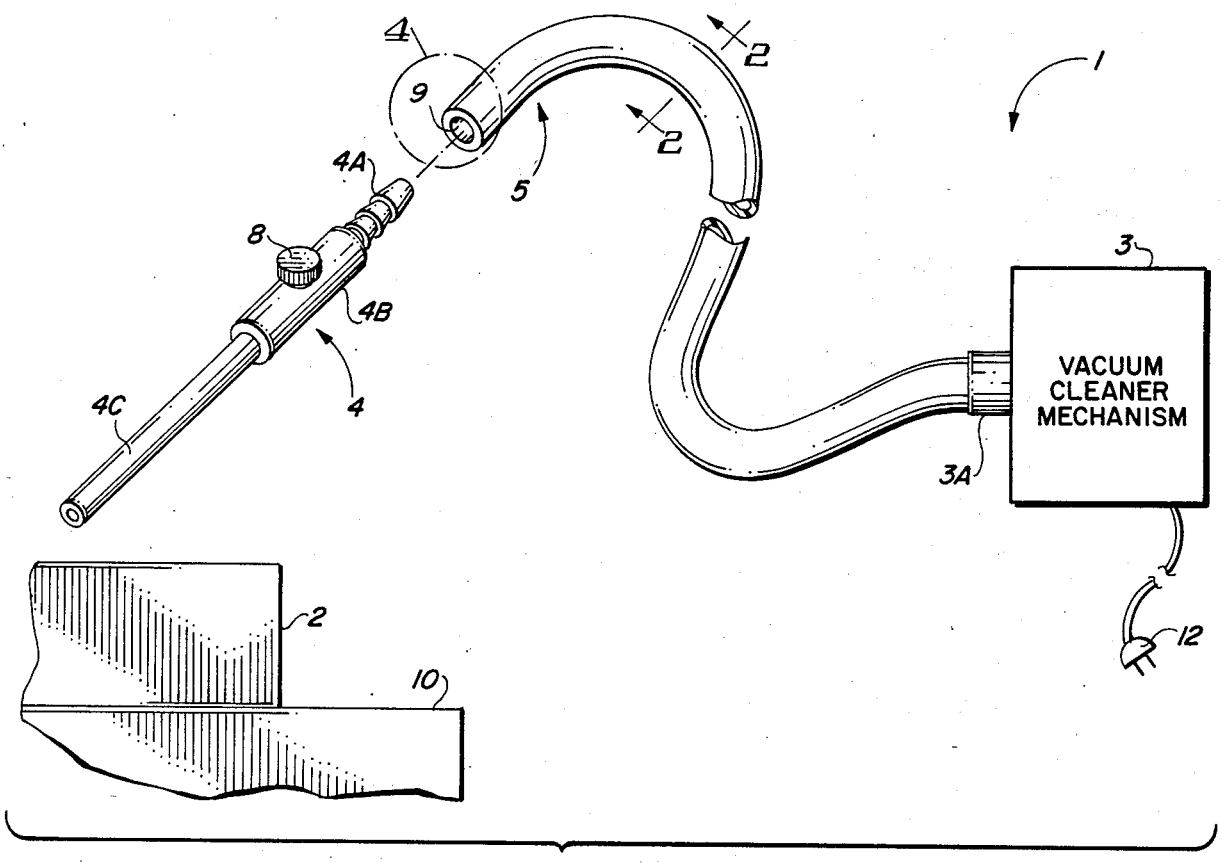
FIG. 1 is a partial perspective view diagram illustrating the antistatic vacuum cleaner system of the present invention.
Figure 2:
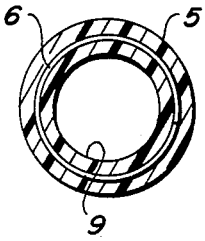
FIG. 2 is a section view taken along section line 1—1 of FIG. 1.

Referring now to the drawings, antistatic vacuum cleaning system 1 includes a vacuum source 3, which can be a common vacuum line in an industrial manufacturing area, or can be a typical industrial vacuum cleaning device including an electric motor and a suction blower and a debris reservoir for collecting items drawn through a flexible vacuum hose 5.

Reference numeral 12 designates an electrical power connector to vacuum cleaner mechanism 3. Flexible vacuum hose 5 has its right-hand end connected to a vacuum inlet 3A by means of a suitable clamp or the like (not shown). The left-hand end of flexible vacuum hose 5 is connected to a vacuum pickup nozzle 4. Vacuum pickup nozzle 4 includes a connector 4A, a main body 4B, and a nozzle section 4C. A valve control knob 8 is utilized to open and close a valve in main body 4B of the pickup nozzle. Connector 4A includes a plurality of tapered flanges that are inserted into the end opening 9 of vacuum hose 5.

Figure 3:
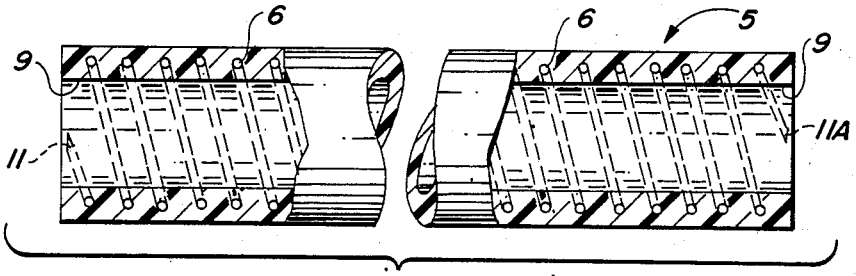
FIG. 3 is a partial cutaway view of the vacuum hose of FIG. 1.
Figure 4:
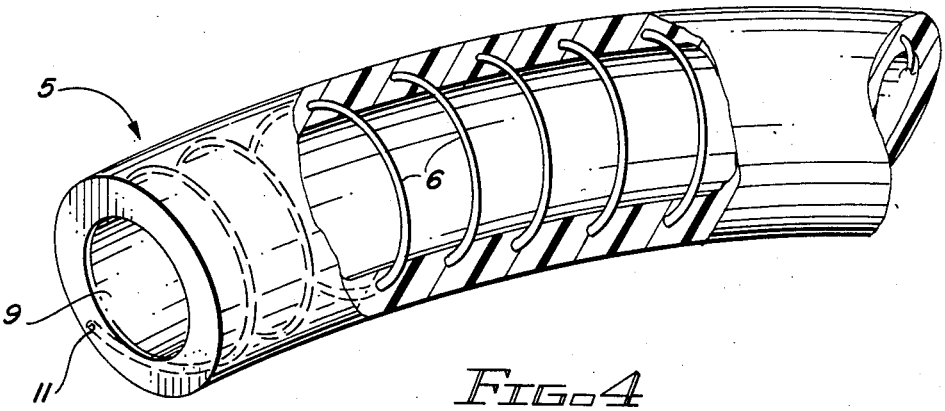
FIG. 4 is an enlarged view of detail 4 of FIG. 1.

In accordance with the present invention, flexible hose 5 is composed of polyvinyl chloride material. In the presently described embodiment of the invention, the outside diameter of flexible vacuum hose 5 is eleven-sixteenths of an inch, and the inside diameter is one-half inch. The hose can be obtained from New Age Industries, of Willow Grove, Pa. Vortex Tubing Item H 050-G. Other sizes of such tubing also have been effectively used, with inside diameters from three-sixteenths of an inch to two inches, and outside diameters from three-eighths of an inch to two and seven-sixteenths inches. A continuous helical metal conductor 6 is embedded within the plastic vacuum hose 5, extending from the right end to the left end. The helical conductor 6 is disposed midway between the outer surface of vacuum hose 5 and the inner surface bounding passage 9, so that no portion of the helical conductor 6 ever contacts any of the air passing through opening 9. Also, no portion of the helical conductor 6 ever makes electrical contact to intake 3A or to any portion of vacuum pickup nozzle 4. Therefore, the entire helical conductor 6 is always electrically "floating". In FIGS. 3 and 4, reference numeral 11 indicates a hole that appears in the plastic along the plane of a transverse cut made when a predetermined length of the tubing is cut. The conductor 6 recedes a way into hole 11, so that no portion of conductor 6 extends beyond the ends of the plastic. Typically, the length of vacuum hose 5 as it is presently being used is in the range from five to seven feet.

I have found that use of the above-described flexible plastic vacuum tube with the embedded, electrically floating helical conductor 6 completely solves the problem of electrostatic charge buildup in the plastic vacuum tube when the above-described vacuum cleaning system is utilized. The vacuum pickup nozzle 4 can be positioned so that its intake end 4C can be brought as close as desired to a sensitive workpiece or piece of complex electronic equipment 2 or the like, located in a work station area 10 without fear that an electrostatic discharge from the end 4C of the vacuum pickup nozzle to the equipment 2 or work station 10 will occur. Use of the same vacuum cleaning machine with a large variety of other flexible hoses that have been tested all resulted in sufficient electrostatic charge buildup that sparks jumped from vacuum pickup 4 to the work station 10 or a workpiece or piece of equipment 2, potentially causing serious damage.

It is not presently understood precisely how the ungrounded, electrically floating helical conductor functions to dissipate or otherwise prevent the electrostatic charge buildup in tube 5 as air is sucked at high speed through vacuum pickup nozzle and flexible hose 6 into vacuum cleaner system 3. Nevertheless, the use and successful adoption of the arrangement shown in FIG. 1 has conclusively proved that substantial electrostatic charge buildup and subsequent discharge is avoided. It is thought that possibly the electrically insulative polyvinyl chloride plastic material of which flexible hose 5 is composed has enough electrical conductivity between the inner surface of opening 9 and the embedded helical conductor 6 to allow small amounts of electrostatic charge buildup to migrate through the plastic to the nearest portion of embedded helical conductor 6, which then allows charge received by embedded helical conductor 6 to travel freely to the inlet end 3A. Although the helical coil does not make electrical connection to vacuum inlet 3A, the conductivity of the plastic material, even though highly insulative, is believed to be high enough to allow the charge on helical conductor 6 to flow to the vacuum inlet 3A and from there to an electrical ground associated with vacuum cleaner mechanism 3, thereby preventing a sufficiently large electrostatic buildup to allow an electrostatic discharge to take place when end 4C of vacuum pickup nozzle 4 is brought very close to an electrically grounded workpiece 2 or portion of work station 10.

Thus, the benefit of complete electrical isolation between vacuum pickup nozzle 4 and vacuum cleaner mechanism 3 is attained, and the benefits of avoiding electrostatic buildup and electrostatic discharge during operation of the antistatic vacuum cleaning system 1 are simultaneously achieved.

While the invention has been described with respect to a particular embodiment thereof, those skilled in the art will be able to make various modifications to the described embodiment of the invention without departing from the true spirit and scope of the invention. It is intended that all techniques which are equivalent to those described herein in that they perform substantially the same function in substantially the same way to achieve the same result are within the scope of the invention. For example, the vacuum cleaning mechanism could be replaced by a blower, and a high speed jet of air could be forced through flexible hose 5 and out of nozzle 4C to blow debris away from or out of the workpiece 2 and/or the work station 10. In any case, the simultaneous benefits of complete electrical isolation between the nozzle 4 and the vacuum cleaner/blower 3 are attained.

I claim:

1. An apparatus for providing electrical isolation between a vacuum source and sensitive equipment being vacuumed and simultaneously avoiding electrostatic discharges from the vacuum pickup to the sensitive equipment, the apparatus comprising in combination:

(a) a vacuum pickup having a vacuum hose connector at one end and a vacuum intake nozzle at another end;

(b) a flexible plastic vacuum hose composed of electrically insulative material and having a first end connected to a vacuum inlet of the vacuum source and a second end connected to the vacuum hose connector;

(c) a continuous, electrically floating helical conductor embedded entirely within the wall of the vacuum hose and extending from the first end to the second end thereof;

whereby electrical isolation between the vacuum pickup and the vacuum source and avoidance of electrostatic discharge from the vacuum pickup to the sensitive equipment being vacuumed are simultaneously achieved.

2. The apparatus of claim 1 wherein the vacuum hose has a predetermined wall thickness and wherein the helical conductor is disposed halfway between an inner surface and an outer surface of the vacuum hose.

3. The apparatus of claim 2 wherein the vacuum hose is composed of polyvinyl chloride plastic material.

4. The apparatus of claim 2 wherein the vacuum pickup includes a control valve disposed therein and an external control to allow a user to open and close the vacuum pickup.

5. The apparatus of claim 2 wherein the material of which the plastic vacuum hose is composed has a sufficiently high resistivity to electrically insulate the vacuum pickup from the vacuum source.

6. The apparatus of claim 5 wherein the material of which the plastic hose is composed is sufficiently conductive to allow accumulated electrostatic charge to migrate through the walls of the vacuum hose to the embedded helical conductor.

7. The apparatus of claim 2 wherein the vacuum source is connected to a power source and operates to produce a vacuum that draws air through the vacuum hose and the vacuum pickup and collects debris vacuumed through the vacuum pickup and the hose.

8. A method of vacuuming equipment, workpieces, and the like that is sensitive to electrostatic discharge, comprising the steps of:

(a) producing a vacuum to draw air through a flexible, electrically insulative vacuum hose and a vacuum pickup nozzle, air being drawn through the electrically insulative vacuum hose tending to cause accumulation of electrostatic charge due to friction between the moving air and the inner surface of the vacuum hose;

(b) providing an electrically floating helical conductor embedded entirely in a wall of the vacuum hose so that air moving through the hose does not come in contact with any portion of the helical conductor; and (c) dissipating or discharging accumulations of electrostatic charge in the vacuum hose by cooperation between the embedded helical conductor and the electrically insulative vacuum hose;

whereby electrical isolation between the vacuum pickup nozzle and a vacuum source producing the vacuum is achieved simultaneously with dissipation of electrostatic charge built up due to friction between air moving through the vacuum hose and the interior surface of the vacuum hose.

9. An apparatus for providing electrical isolation between a means for moving air and sensitive equipment being vacuumed and simultaneously avoiding electrostatic discharges from the air moving means to the sensitive equipment, the apparatus comprising in combination:

(a) a nozzle having a hose connector at one end and an air inlet/outlet aperture at the other end;

(b) a flexible plastic hose composed of electrically insulative material and having a first end connected to a port of the air moving means and a second end connected to the air inlet/output aperture;

(c) a continuous, electrically floating, helical conductor embedded entirely within the wall of the hose and extending from the first end to the second end thereof;

whereby electrical isolation between the nozzle and the air moving means and avoidance of electrostatic discharge from the nozzle to the sensitive equipment are simultaneously achieved.

* * * * *